US010590846B2

(12) United States Patent
Vericker et al.

(10) Patent No.: US 10,590,846 B2
(45) Date of Patent: Mar. 17, 2020

(54) VALVE COVER EXTENSION TUBE WITH INTEGRATED SENSOR

(71) Applicant: Caterpillar Inc., Peoria, IL (US)

(72) Inventors: David A. Vericker, Metamora, IL (US); Philip C. Spengler, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/467,506

(22) Filed: Mar. 23, 2017

(65) Prior Publication Data

US 2018/0274402 A1 Sep. 27, 2018

(51) Int. Cl.

| | |
|---|---|
| ***F02B 77/08*** | (2006.01) |
| ***F01M 11/10*** | (2006.01) |
| ***F01M 11/12*** | (2006.01) |
| *F01M 11/04* | (2006.01) |

(52) U.S. Cl.

CPC ..... *F02B 77/08* (2013.01); *F01M 11/10* (2013.01); *F01M 11/12* (2013.01); *F01M 2011/0491* (2013.01); *F01M 2011/14* (2013.01); *F02B 77/083* (2013.01)

(58) Field of Classification Search

CPC ..... F01L 3/24; F01L 3/08; F01L 9/02; F01M 7/00; F01M 1/10; F01M 1/12; F01M 11/12; F01M 11/04; F01M 11/0458; F01M 2011/0491; F01M 2011/1406; F01M 2011/1413; F01M 2011/1493; F01M 2011/148; F02B 77/082; F02B 77/08; F02B 77/085; F02F 7/006; F02F 7/0068; F02F 7/0065; G01P 13/008; F16N 19/003; F16K 5/0285; F16K 5/0292; F16K 5/0492; F16K 25/005; F16K 27/064; F16K 27/107; G01M 15/002; G01F 23/268; G01F 23/0046; G01F 23/248

USPC ..... 123/196 R

See application file for complete search history.

(56) References Cited

U.S. PATENT DOCUMENTS

| | | | | |
|---|---|---|---|---|
| 4,343,316 A * | 8/1982 | Jespersen | A61B 5/201 600/575 |
| 4,733,556 A * | 3/1988 | Meitzler | B01D 27/08 340/631 |
| 4,739,861 A * | 4/1988 | Desjardins | F01M 11/04 141/330 |
| 9,068,528 B2 | 6/2015 | Toyota | |

(Continued)

FOREIGN PATENT DOCUMENTS

| | | |
|---|---|---|
| CN | 205383003 U | 7/2016 |
| FR | 2738293 A1 | 3/1997 |

*Primary Examiner* — George C Jin

(74) *Attorney, Agent, or Firm* — Miller, Matthias & Hull

(57) ABSTRACT

A tube assembly for monitoring a fluid dispensed into a fluid fill port is disclosed. The tube assembly may include a tube body disposed between a first and second open end. A locking portion including a circumferential groove may be defined adjacent to the first open end and a fill portion may be defined at the second open end of the tube body. An aperture may extend through an outer surface of the tube body and a sensor may be inserted into the aperture such that at least a portion of the sensor is positioned within the interior portion of the tube body. The sensor may be configured to monitor at least one fluid characteristic of the fluid that is dispensed into the tube assembly and flows into the fluid fill port.

19 Claims, 8 Drawing Sheets

(56) References Cited

U.S. PATENT DOCUMENTS

| | | | | |
|---|---|---|---|---|
| 2012/0313369 | A1* | 12/2012 | Ratschmann | F16L 13/143<br>285/347 |
| 2013/0276742 | A1* | 10/2013 | Mallett | F01M 7/00<br>123/196 R |
| 2014/0130587 | A1* | 5/2014 | Von Herzen | G01N 33/2888<br>73/114.55 |
| 2014/0311240 | A1* | 10/2014 | Fitch | F01M 11/0408<br>73/334 |
| 2015/0075268 | A1* | 3/2015 | Qi | G01N 27/22<br>73/114.55 |
| 2016/0195037 | A1 | 7/2016 | Aisin | |

* cited by examiner

VALVE COVER EXTENSION TUBE WITH INTEGRATED SENSOR

TECHNICAL FIELD

The present disclosure relates to engines and, more particularly, relates to an extension tube that is coupled to a valve cover and configured for filling an engine fluid into the engine.

BACKGROUND

Internal combustion engines, such as but not limited to, diesel engines, gasoline engines, natural gas engines, and the like may generate power needed to operate industrial mining equipment, earth-moving equipment, locomotives, on-road trucks, off-road trucks, marine vessels, electricity generating equipment, and other such machines and equipment. Engines are composed of many moving parts which may require proper lubrication to function properly. During normal operation, engine fluid such as but not limited to, engine oil may flow or circulate throughout the engine to provide lubrication, cooling, protection against corrosion, or for other such reasons. Additionally, machines configured with internal combustion engines, or other such power generating sources, may often be operated under harsh environmental conditions that include extreme temperatures, dust, moisture, and other such conditions. In certain cases, the harsh environmental conditions may reduce the operational lifetime of engine fluids, thereby reducing time between maintenance intervals and increasing machine downtime. Furthermore, byproducts of the combustion process, such as carbon particles, ash and soot may create additional contamination sources of engine fluids and other machine components.

As a result, to increase the time between maintenance intervals the optimized engine fluids may be used that are configured to better combat the harsh environmental conditions and repel the contamination sources. In some cases, it may be beneficial to monitor the fluid characteristics of the engine fluid during machine maintenance. Therefore, one or more sensors may be incorporated with the engine or other machine system and the one or more sensors may be configured to monitor and collect data related to the engine and/or machine fluid being added to the machine.

However, the engine compartment in some machines may have a limited amount of available space. As a result, it may be difficult to place the sensors in the proper position on the engine so the engine and/or machine fluid can be monitored during machine maintenance procedures. An extension tube, or other such fluid conduit, may be mounted on the engine and configured to provide access for the sensor. Moreover, the extension tube may be configured such that one end of the tube is coupled to the fluid fill port and the opposite end defines a new fill position for the engine and/or machine fluid. One or more sensors may be positioned between the first and second end of the tube and the one or more sensors may be configured to monitor the fluid as is flows through the tube. As a result, it may be desired that the extension tube be sized accordingly to provide enough room for the one or more sensors to be positioned in the tube and that the extension tube may be attached to the engine using the available space within the engine compartment.

A method and apparatus for sealing a cam shaft and providing a shaft speed detection structure is disclosed in Chinese Utility Model Patent No. CN205383003U, (the '003 patent). The sealing method and apparatus disclosed therein includes a cover surrounded by an accommodating space for a cam shaft to extend there through. The cover also includes a sensor mounting portion for mounting the speed sensor. The cover is formed to provide an accommodating space for the cam shaft and the cover is removably attached to a cylinder head of an engine, thereby sealing the interior of the cylinder head. Furthermore, the sensor mounting portion is configured to accommodate the speed sensor being inserted into the mounting portion in order to measure the rotational speed of the cam shaft. As a result, the cover provides a seal for the cam shaft and a structure to mount the speed sensor to continuously detect the rotational speed of the cam shaft.

While the '003 patent shows an apparatus for sealing and detecting a rotational speed of a cam shaft, it fails to disclose an extension tube having one or more sensors for monitoring engine fluid as it is added into an engine or engine fluid reservoir.

SUMMARY OF THE DISCLOSURE

In accordance with one embodiment of the present disclosure, a tube assembly for attaching to a fluid fill port is disclosed. The tube assembly may include a tube body extending between a first open end and a second open end. Furthermore, a tube attachment portion may be formed at the first open end of the tube body, wherein the tube attachment portion of the tube body may be inserted into the fluid fill port and the first open end may be aligned with and coupled to the fluid fill port. The tube assembly may further include a fill portion defined at the second open end of the tube body, and the fill portion may be spaced an axial distance away from the tube attachment portion. Moreover, an aperture may be formed in the tube body and the aperture may be located between the first open end and the second open end. The aperture may be configured to extend from an outer surface of the tube body into an interior portion of the tube body. Furthermore, the tube assembly may include a sensor inserted into the aperture, wherein at least a portion of the sensor is positioned within the interior portion of the tube body. The sensor may be configured to monitor at least one fluid characteristic of a fluid that is dispensed into the fill portion and flows through the interior portion of the tube body and into the fluid fill port.

In accordance with another embodiment of the present disclosure, a tube assembly for extending a fluid fill port of an engine valve cover is disclosed. The tube assembly may include a tube body extending between a first open end and a second open end. Moreover, a tube attachment portion may be formed at the first open end, wherein the tube attachment portion of the tube body may be inserted into the fluid fill port and the first open end may be aligned with the fluid fill port and the tube attachment portion is coupled to the engine valve cover. The tube assembly may further include a fill portion defined at the second open end of the tube body, and the fill portion may be spaced a distance away from the tube attachment portion. A cap attachment portion may be formed at the second open end of the tube body and the cap attachment portion may be configured to secure a removable cap of the engine valve cover that covers the fill portion when not in use. Furthermore, an aperture may be formed in the tube body, the aperture may be located between the first open end and the second open end and the aperture may be configured to extend from an outer surface of the tube body into an interior portion of the tube body. The tube assembly may further include a sensor inserted into the aperture, wherein at least a portion of the sensor may be positioned within the interior portion of the tube body. The sensor may be configured to monitor at least one fluid characteristic on an engine fluid that is dispensed into the fill portion and the engine fluid flows through the interior portion of the tube body and into the engine valve cover. Additionally the tube assembly may include a guttering structure formed within the interior portion of the tube body, and the guttering structure may be configured to define an internal fluid flow pathway within the interior portion of the tube body.

In yet another embodiment of the present disclosure, a machine is disclosed. The machine may include an engine compartment configured to house an engine, and the engine may be configured to include at least one valve cover. A valve cover fluid fill port may be formed in the at least one valve cover and the engine valve cover fluid fill port may be configured to fill the engine with an engine fluid. The machine may further include a tube assembly coupled to the valve cover fluid fill port, the tube assembly comprising a tube body extending between a first open end and a second open end. Moreover, a tube attachment portion may be formed at the first open end of the tube body, wherein the first open end of the tube body may be inserted into the valve cover fluid fill port and the first open end may be aligned with the valve cover fluid fill port and the tube attachment portion may be coupled to the at least one valve cover. The machine and tube assembly may further include a fill portion defined at the second open end of the tube body, and the fill portion may be spaced an axial distance away from the tube attachment portion. A cap attachment portion may be formed at the second open end of the tube body, and the cap attachment portion may be configured to secure a removable cap of the at least one valve cover that covers the fill portion when not in use. Furthermore, an aperture may extend through the outer surface of the tube body and into an interior portion of the tube body. The aperture may be positioned along the axial distance between the tube attachment portion and the fill portion. The machine and tube assembly may further include a sensor inserted into the aperture, wherein at least a portion of the sensor is positioned within the interior portion of the tube body. The sensor may be configured to monitor at least one fluid characteristic of the engine fluid that is dispensed into the fill portion and the engine fluid flows through the interior portion of the tube body and into the at least one valve cover. Additionally, an electronic controller may be communicably coupled to the sensor, wherein the sensor may be configured to transmit a sensor data set to the electronic controller and the electronic controller may be programmed to analyze and store the sensor data set.

DETAILED DESCRIPTION

Figure 1:
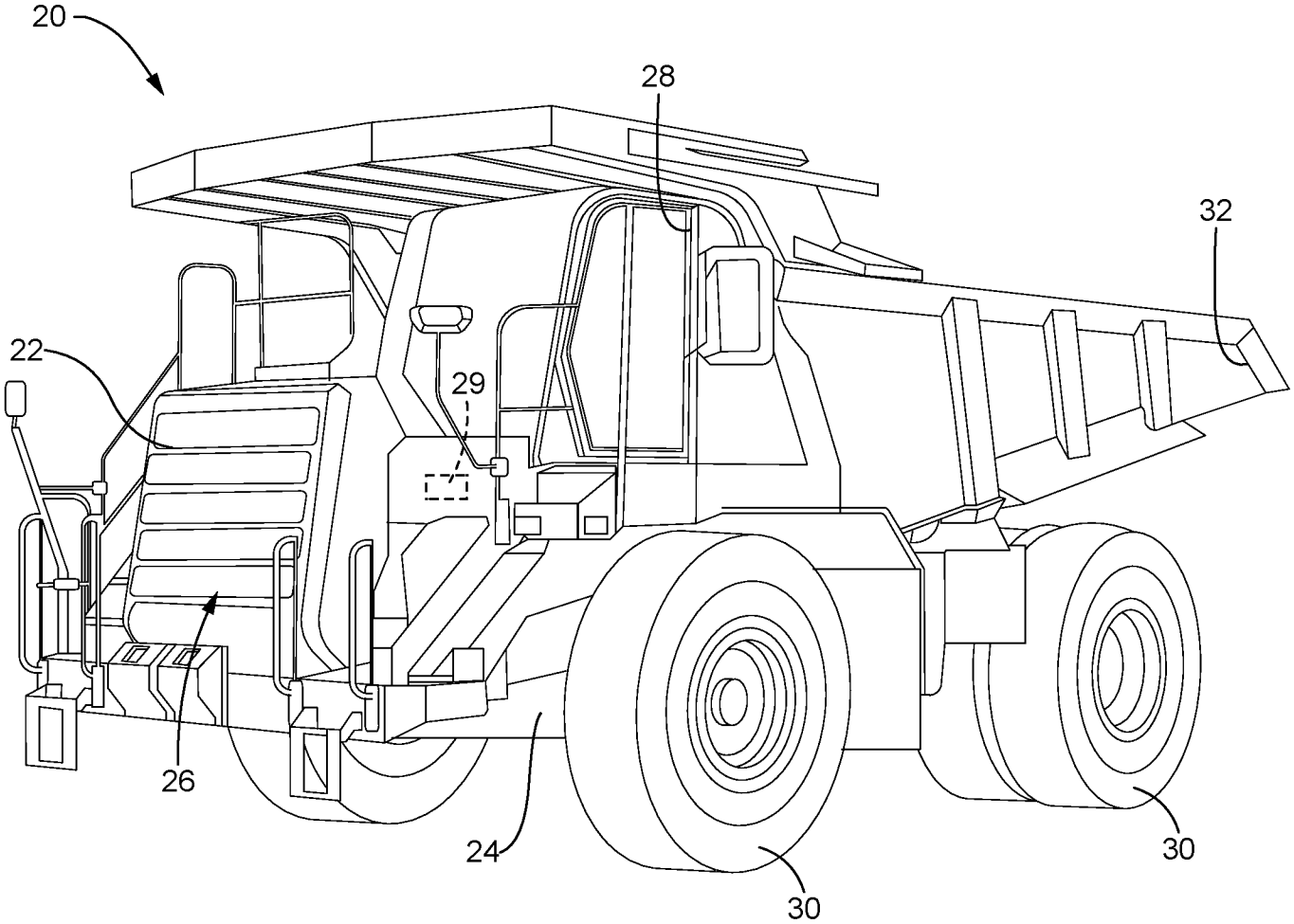
FIG. 1 is a perspective view of an exemplary machine incorporating a tube assembly in accordance with the present disclosure.

Referring now to the drawings and with specific reference to FIG. 1, an exemplary embodiment of a machine constructed in accordance with the present disclosure is generally referred to by reference numeral 20. While one non-limiting example is shown, the machine 20 may refer to a piece of equipment incorporating an engine 22, such as, but not limited to, an off-road truck, on-road truck, earth moving equipment, industrial mining equipment, locomotive, marine vessel, electricity generating equipment or other such piece of equipment. Furthermore, the engine 22 incorporated with the machine 20 may be an internal combustion engine, a diesel engine, a natural gas engine, a hybrid engine or any combination thereof, and the engine 22 may be configured as a power generating source that produces the operational power needed by the machine 20.

The machine 20 may be constructed as having a frame 24 which supports the engine 22. In some embodiments, the engine 22 may be rigidly attached to the frame 24, and the engine 22 may be disposed within an engine compartment 26 which defines a space that contains the engine 22 and other assorted components necessary for operation of the machine 20. Additionally, the machine 20 may be configured with an operator compartment 28 that is supported by the frame 24, and the operator compartment 28 may include a set of operational controls (not shown) for an operator to manipulate during operation of the machine 20. Furthermore, the operator compartment 28 may include an electronic controller 29 that is in electronic communication with the engine 22 and other systems and components of the machine 20. In some embodiments, the set of operational controls (not shown) and the electronic controller 29 may be programmed, or otherwise configured to control a plurality of operational functions of the machine 20. For example, the operational controls (not shown) may include controls such as but not limited to, throttle controls of the engine 22, steering controls of a set of ground engaging elements 30, tool controls of the machine 20, and other such controls. In some embodiments, adjustment of the operational controls (i.e., throttle, and steering) may be detected by the electronic controller 29. As a result, the electronic controller 29 may then send a control signal to the engine 22, the ground engaging elements 30, or other such component of the machine 20 and the control signal may be configured to adjust the operation of the machine 20.

Moreover, the set of ground engaging elements 30 are illustrated as a set of wheels that may be operable attached to the frame 24. However, the ground engaging elements 30 may alternatively be configured as a set of tracks or the like. Generally, the ground engaging elements 30 may link the machine 20 with the ground, or other such operational environment, and the ground engaging elements 30 may assist steering and maneuvering the machine 20 around the work site. In some embodiments, the engine 22 may generate the power that is supplied to the ground engaging elements 30 in order to propel the machine 20 in a direction of travel, and the operator may manipulate the controls in the operator compartment 28 to control the speed, direction, and other such operational parameters of the machine 20. The machine 20 may further include a load bin 32 that is configured to haul a load from one place to another and dump the load in a desired location. While the machine 20 illustrated in FIG. 1 is equipped with the load bin 32, it will be understood that the machine 20 may have additional or alternative attachments and/or tools such as but not limited to, a shovel, a blade, a hammer, and the like.

Figure 2:
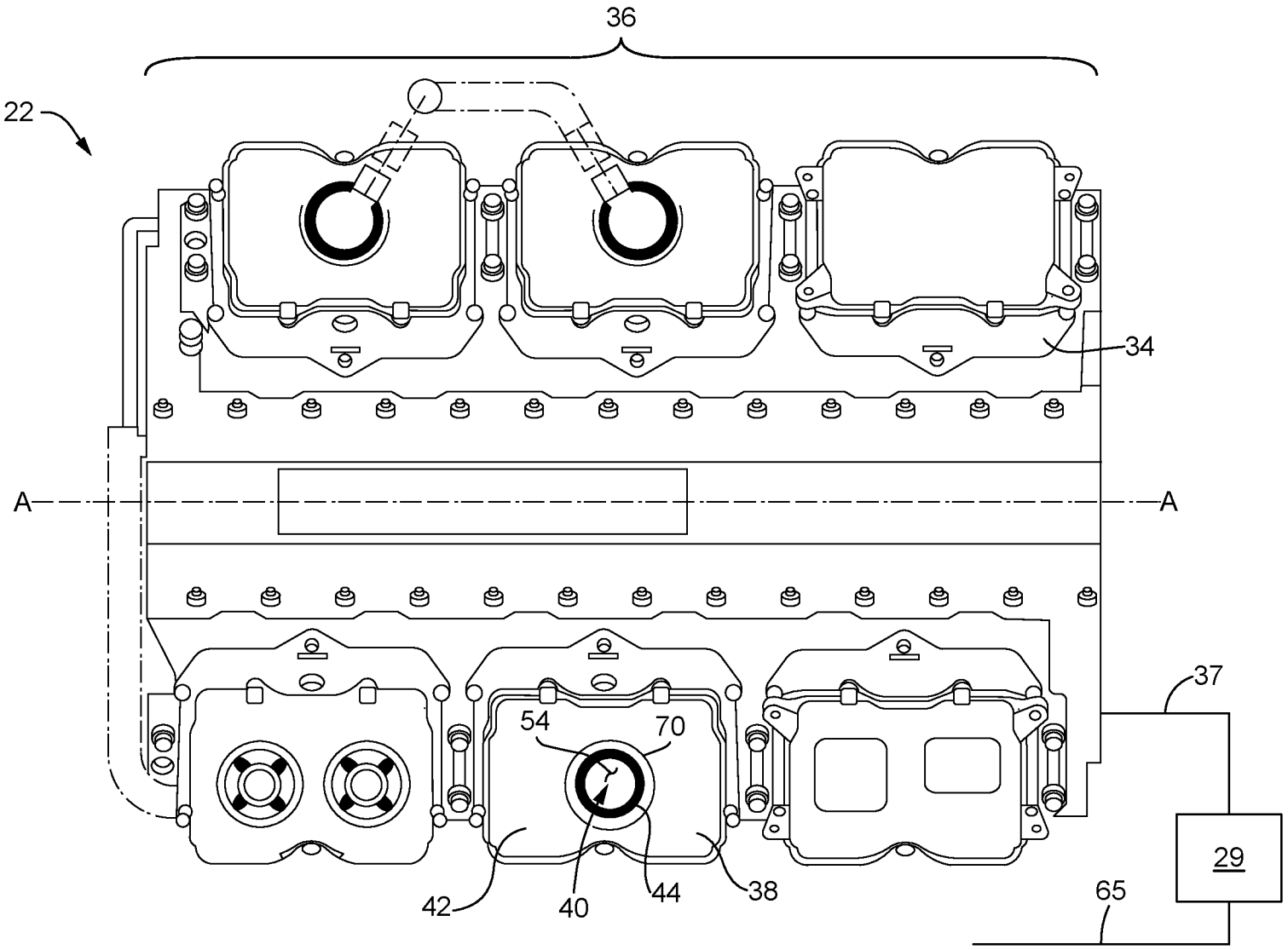
FIG. 2 is a plan view of an engine in the machine of FIG. 1 in accordance with an embodiment of the present disclosure.

FIG. 2 provides an exemplary top view of the engine 22 that may reside in the engine compartment 26 (FIG. 1) of the machine 20 (FIG. 1). In one non-limiting example, the engine 22 may be configured as a diesel engine; however other types of engines such as, an internal combustion engine, a gasoline engine, a natural gas engine, a hybrid engine, or any combination thereof may be used. Furthermore, the engine 22 may be configured to include one or more cylinder heads 34 that surround one or more cylinders (not shown), pistons (not shown), and other components of the engine 22. The non-limiting embodiment illustrated in FIG. 2 shows the engine 22 includes six cylinder heads 34, and each cylinder head 34 may include two cylinders (not shown); however other configurations of the cylinder heads 34 and cylinders (not shown) of the engine 22 are possible. Furthermore, in some embodiments, the engine 22 may be configured to be a v-style engine where the cylinder heads 34 are arranged in two separate cylinder head banks 36, and the separate cylinder head banks 36 may be set at an angle with respect to an axis A-A of the engine 22. Alternatively, the engine 22 may be configured to be an in-line engine where the cylinders (not shown), pistons (not shown) and cylinder heads 34 are arranged in a single row. However, other configurations of the engine 22 and the cylinder heads 34 may be possible.

Additionally, the engine 22 may be operably coupled to the electronic controller 29 by one or more lead wires 37. As a result, the electronic controller 29 and the engine 22 may be in electronic communication with each other such that electronic data may be shared between the electronic controller 29 and the engine 22. Furthermore, the electronic controller 29 may be configured to display or otherwise communicate the electronic data received from the engine 22 or other system of the machine 20. As a result, the operator or other interested personnel may be able to access and analyze the electronic data displayed by the electronic controller 29.

As further illustrated in FIG. 2, the engine 22 may utilize one or more valve covers 38 which are placed on top of each cylinder head 34. Moreover, each valve cover 38 may function as a covering or lid for each cylinder head 34. As such, the cylinder head 34 and valve cover 38 may form an enclosure which houses the cylinders (not shown) and pistons (not shown), and other components of the engine 22. In some embodiments, the engine 22 may be configured such that a valve cover 38 is attached to each cylinder head 34 of the engine 22. However, alternative embodiments of the engine 22 may include one or more valve covers 38 configured to cover one or more cylinder heads 34. For example, each cylinder head bank 36 may include a single valve cover 38 configured to cover the plurality of cylinder heads 34 within each cylinder head bank 36. However, it will be understood that other configurations of the cylinder heads 34, and valve covers 38 may be possible.

Furthermore, the engine 22 may include a number of moving and/or rotating components, such as but not limited to, cylinders (not shown), pistons (not shown), valves (not shown), and other such components. During operation, these components may continuously slide, move and/or rotate for an extended period of time. For example, the engine 22 may be incorporated into a machine 20 that operates continuously around a work site and the engine 22 may similarly operate to produce the power required for machine 20 operation. In some cases the machine 20 may need to operate for as little as five minutes at a time or as much as twelve hours or more. However, operation time can vary. Due to the continuous and repetitive motion of certain components, the engine 22 may incorporate lubricating fluids, temperature regulating fluids, and other such fluids and materials to help properly lubricate, cool, and otherwise protect the components of the engine 22 during operation. In one non-limiting example, the engine 22 may use an engine fluid, such as but not limited to engine oil, engine coolant, transmission fluid, fuel, grease, lubricant, or other such material to ensure the moving components are sufficiently lubricated, cooled and protected.

Characteristics of the engine fluids may degrade over time and with continued use. As a result, the various engine fluids may need to be monitored during operation to check for degradation in fluid quality as well as to maintain a sufficient fluid level. In some cases, additional engine fluid may need to be added to the engine 22 if the levels are found to be low. Additionally, or alternatively, if the engine fluids are found to have degraded or become otherwise contaminated, then the entire engine fluid supply may be replaced. The valve cover 38 may be configured with a fluid fill port 40 that provides a fluid fill pathway for adding additional engine fluid, such as engine oil to the engine 22. The fluid fill port 40 may be formed in a top surface 42 of the valve cover 38, and the fluid fill port 40 may extend through the top surface 42 into an interior portion 54 of the valve cover 38 and/or the engine 22. Moreover, the fluid fill port 40 may be configured to correspond with a specific engine fluid. In one non-limiting example, the fluid fill port 40 may be configured as an engine oil fill port used to fill the engine 22 with engine oil. However, the fluid fill port 40 may be alternatively configured for filling other types of engine or machine 20 fluid, such as engine coolant, transmission fluid, fuel, and the like.

FIG. 2 further illustrates the engine 22 having a single fluid fill port 40 formed in one of the valve covers 38. However, the engine 22 may be configured such that a plurality, or even all, of the valve covers 38 may include a fluid fill port 40 formed in the top surface 42 of the valve cover 38. Furthermore, a tube assembly 44 may be coupled to the top surface 42 of the valve cover 38 and the tube assembly 44 may substantially surround the fluid fill port 40. In some embodiments, the tube assembly 44 may provide a fluid fill pathway that extends upwards or otherwise away from the top surface 42 of the valve cover 38. Moreover, the valve cover 38 may be made out of aluminum, stainless steel, polymer, resin, or other suitable material. In some embodiments, valve cover 38 may be formed using a casting, stamping, injection molding, or other such manufacturing process that is able to form the fluid fill port 40 during formation of the valve cover 38. Alternatively, the fluid fill port 40 may be machined or otherwise formed during a separate manufacturing step.

Figure 3:
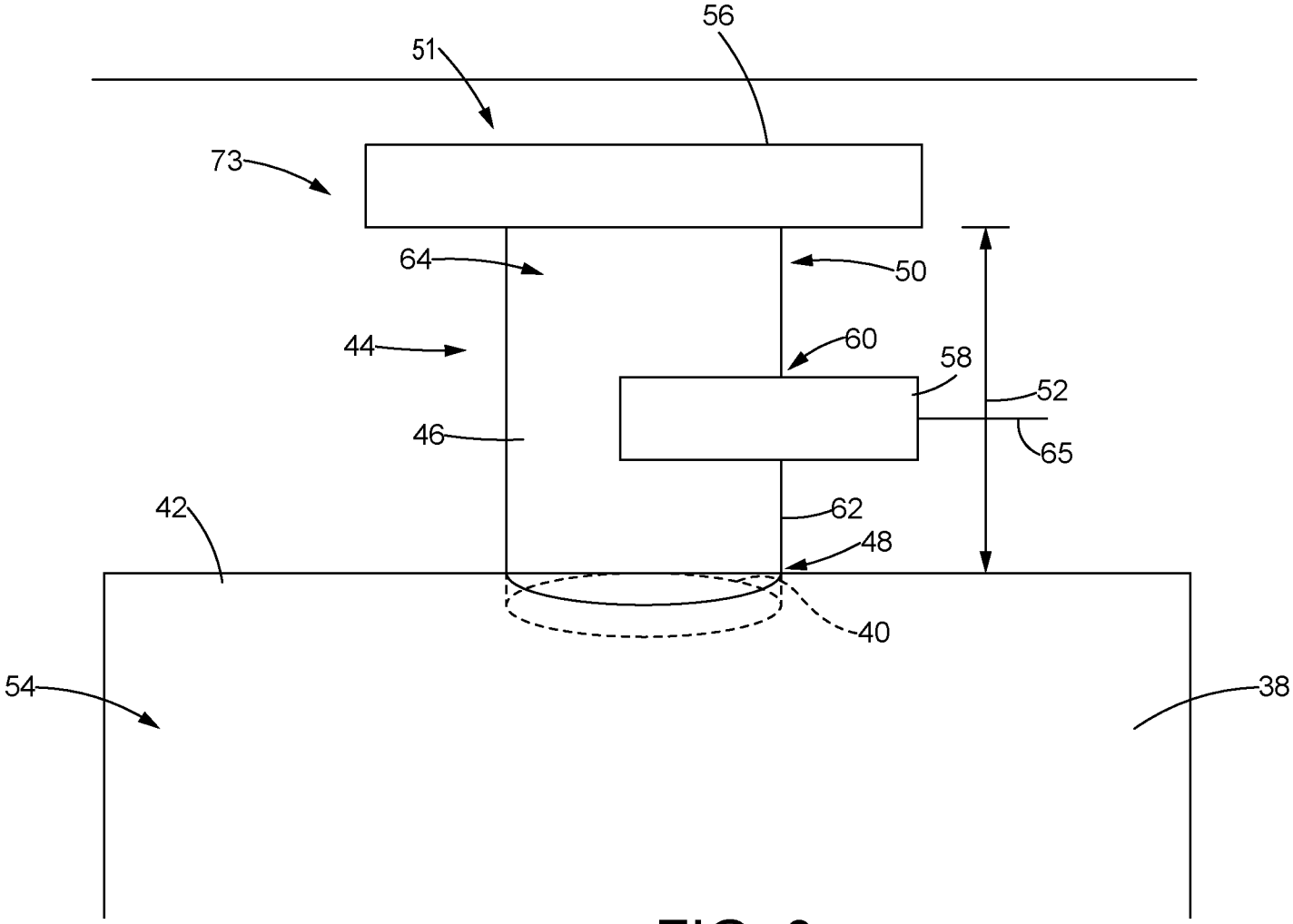
FIG. 3 is a schematic illustration of an embodiment of the tube assembly in accordance with an embodiment of the present disclosure.

Referring now to FIG. 3, a schematic of the tube assembly 44 attached to the fluid fill port 40 formed in the top surface 42 of the valve cover 38 is shown. In some embodiments, the tube assembly 44 may be used to add engine fluid through the fluid fill port 40 of the valve cover 38; however the tube assembly 44 may be used to fill fluids used in other locations of the machine 20 as well. The illustration of the tube assembly 44 attachment to the valve cover 38 is one non-limiting example of how the tube assembly 44 may be used with the machine 20 (FIG. 1). In alternative embodiments, the tube assembly 44 may be coupled to additional or alternative machine systems such as but not limited to, a hydraulic system (not shown), a fuel system (not shown) a cooling system (not shown), a transmission or drive train (not shown), or other such machine system. As a result, the tube assembly 44 may additionally or alternatively be used to fill the machine 20 (FIG. 1) with hydraulic fluid, fuel, transmission fluid, coolant, or other such fluid.

The tube assembly 44 may include a tube body 46 that extends, or is otherwise disposed, between a first open end 48 and a second open end 50 of the tube assembly 44. In some embodiments, the tube body 46 forms a cylindrical structure that extends away from the top surface 42 of the valve cover 38. Furthermore, the first open end 48 of the tube assembly 44 may be placed or positioned adjacent to the top surface 42 such that the first open end 48 of the tube assembly 44 is aligned with the fluid fill port 40 formed in the valve cover 38. The second open end 50 of the tube assembly 44 may define a secondary fluid fill port 51 that is spaced an axial distance 52 above the fluid fill port 40 formed in the valve cover 38. As a result, the tube assembly 44 may form an extended fluid fill pathway that extends the axial distance 52, between the fluid fill port 40 and the secondary fluid fill port 51. Moreover, in some embodiments, the tube assembly 44 and/or the tube body 46 may be formed using a pre-determined dimension (i.e., length, diameter) to specify the axial distance 52 between the first open end 48 and the second open end 50 of the tube assembly 44. For example, the tube assembly 44 may configured to be attached to the engine 22 (FIG. 1) and left in place during operation. Therefore, the tube assembly 44 may size or specify the axial distance 52 such that the tube assembly 44 is compatible with and fits into the available space within the engine compartment 26 (FIG. 1).

Furthermore, the tube assembly 44 may include a removable cap 56 that can be secured onto the second open end 50 of the tube assembly 44 and cover the secondary fluid fill port 51 when not in use. The removable cap 56 may be removed from the second open end 50 to expose the secondary fluid fill port 51 and repositioned over the second open end 50 to close off the secondary fluid fill port 51. When the tube assembly 44 is aligned with the fluid fill port 40 and coupled to the top surface 42 of the valve cover 38, the removable cap 56 may be removed such that engine fluid that is poured, or otherwise dispensed, into the secondary fluid fill port 51 may flow through the tube body 46 into the fluid fill port 40. The engine fluid may then continue to flow through the fluid fill port 40 and into the interior portion 54 of the valve cover 38 and/or engine 22.

In some embodiments, the tube assembly 44 may further include a sensor 58 such as but not limited to, a color sensor, a light sensor, a pH sensor, a particle sensor, a flow sensor, a temperature sensor, or other such sensor. Furthermore, an access port or aperture 60 may be formed through an outer surface 62 of the tube body 46. The sensor 58 may be inserted into the aperture 60 such that at least a portion of the sensor 58 extends into an interior portion 64 of the tube body 46. As a result, the sensor 58 may be positioned within the interior portion 64 of the tube body 46, and the sensor 58 may be configured to monitor, or otherwise interact, with engine fluid, or other such fluid that is poured into the tube assembly 44 through the secondary fluid fill port 51. For example, an engine fluid such as but not limited to, engine oil may be poured into the secondary fluid fill port 51 to fill, or otherwise add engine oil to the engine 22. As the engine oil, or other such fluid, flows through the interior portion 64 of the tube body 46, the engine oil may flow past the sensor 58. The sensor 58 may be able to monitor and collect one or more fluid characteristics of the engine oil as the engine oil, or other such fluid. In some embodiments, the sensor 58 may be configured to monitor, the fluid clarity, fluid viscosity, fluid temperature, fluid flow rate, fluid particle count, fluid pH, or other such fluid characteristic.

Moreover, the sensor 58 may be operably coupled to the electronic controller 29 (FIG. 2) through one or more lead wires 65. In some embodiments, the sensor 58 and the electronic controller 29 may be in electronic communication with one another such that the one or more fluid characteristics, or other such fluid data collected by the sensor 58 may be transmitted to the electronic controller 29. The electronic controller 29 may be programmed to further analyze the one or more fluid characteristics and/or store the collected data to be accessed at a later time. As discussed above, attaching the tube assembly 44 to the valve cover 38 and configuring the tube assembly to monitor and collect data of engine oil being filled into the fluid fill port 40 is one exemplary use of the tube assembly 44. The tube assembly 44 may additionally or alternatively be configured to be attached to the hydraulic system, fuel system, cooling system, transmission, drive train, or other such system of the machine 20. Moreover, the tube assembly 44 and the sensor 58 may be alternately configured to monitor and collect data from fluids such as but not limited to, hydraulic fluid, fuel, coolant, transmission fluid, or other such machine fluid.

Figure 4:
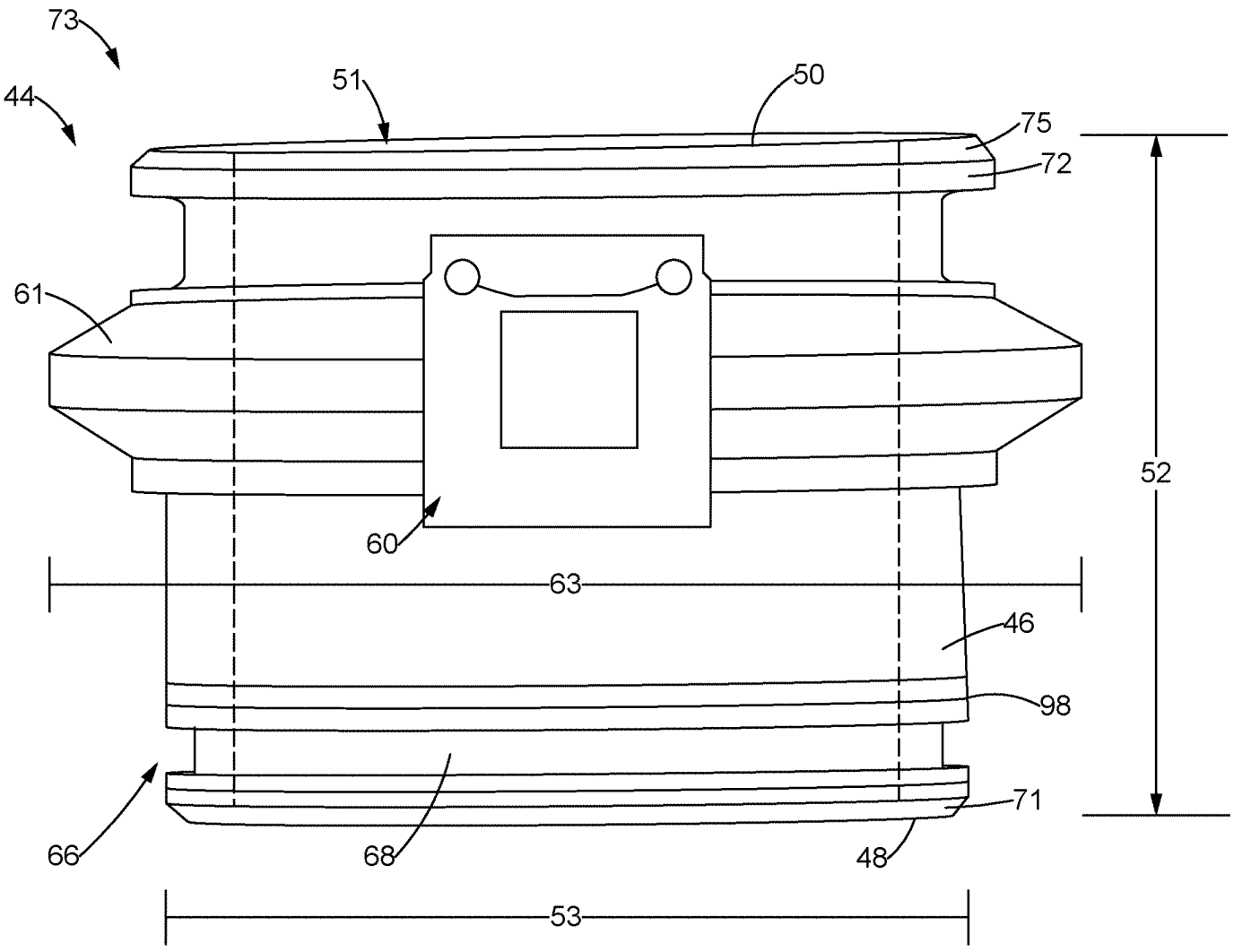
FIG. 4 is a side view of the tube assembly in accordance with an embodiment of the present disclosure.
Figure 5:
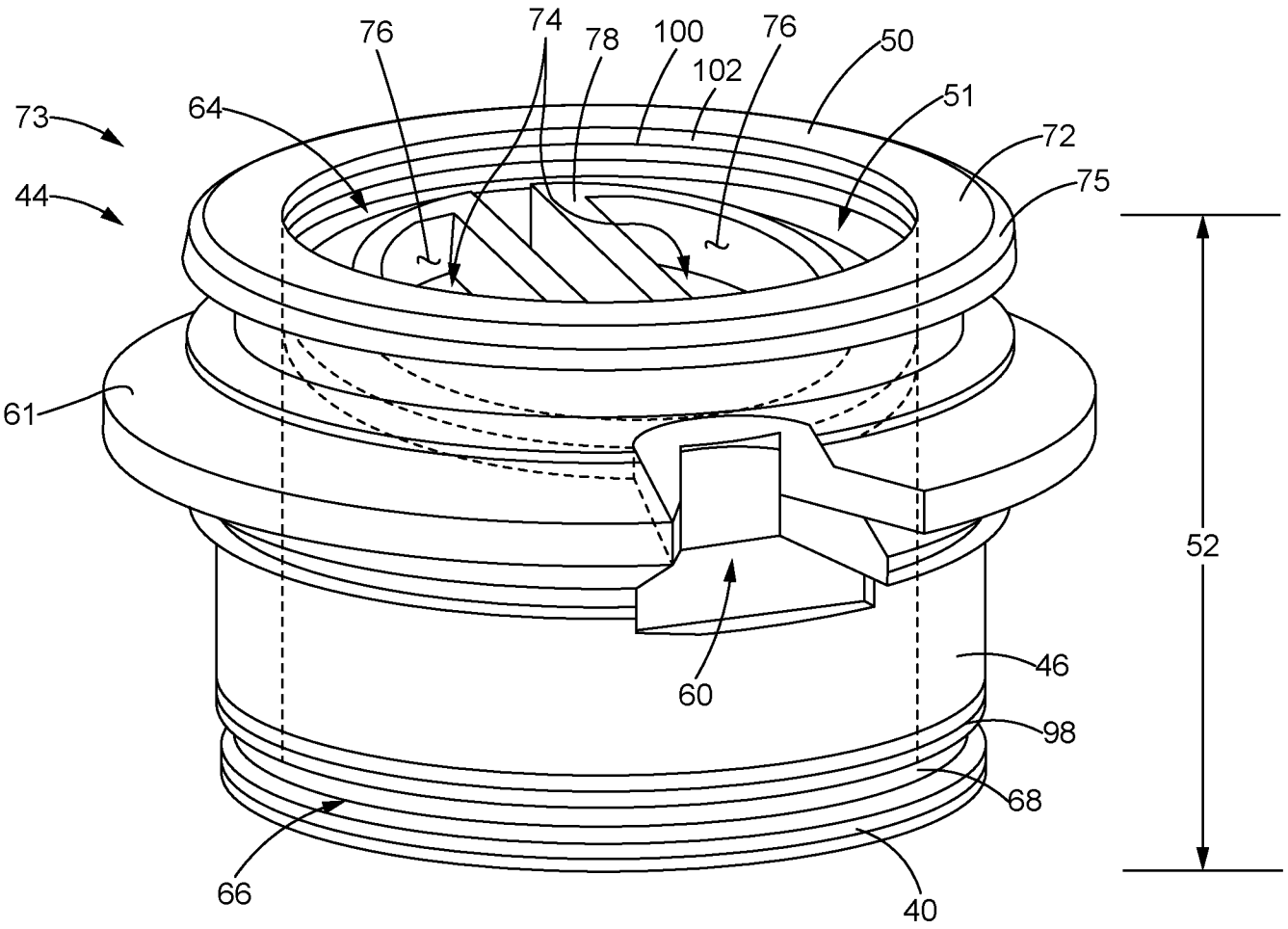
FIG. 5 is a perspective view of the tube assembly of FIG. 4, in accordance with an embodiment of the present disclosure.

Referring now to FIGS. 4 and 5, an exemplary tube assembly 44 in accordance with the present disclosure is shown. Generally, the tube assembly 44 may be configured as a cylindrical structure that includes an opening at the first open end 48 and an opening at the second open end 50. The tube assembly 44 may further include the tube body 46 that is disposed between the first open end 48 and the second open end 50. In some embodiments, the tube assembly 44 may be configured with certain design requirements in order to conform to space limitations in the engine compartment 26 (FIG. 1), or other locations where the tube assembly 44 may be used. As a result, the tube body 46 may have a specific height, or other such dimension, that defines the axial distance 52 between the first open end 48 and the second open end 50 of the tube assembly 44. Furthermore, the tube assembly 44 may be configured with a specific diameter 53 such that the first open end 48 and the second open end 50 are sized as needed. The first open end 48 and the second open end 50 may be configured to have the same diameter 53. However, in other embodiments of the tube assembly 44 the first open end 48 and the second open end 50 may be configured with different diameters 53.

In one non-limiting example, the axial distance 52 between the first open end 48 and the second open end 50 may be configured to provide sufficient room for the sensor 58 to be inserted through the aperture 60 of the tube assembly 44. Additionally, the axial distance 52 may be specified in order to form a tube assembly 44 that is compatible with the available space within the engine compartment 26 (FIG. 1), or other location of the machine 20 (FIG. 1). In some embodiments, the axial distance 52 may be configured such that the tube assembly 44 has a height between 4 inches and 6 inches; however other dimensions are possible. Alternatively, instead of using a fixed axial distance 52 between the first open end 48 and the second open end 50, the tube assembly 44 may be configured to be adjustable such that the axial distance 52 may be increased and/or decreased to adjust the height, or other such dimension, of the tube assembly 44 as needed.

Furthermore, the tube assembly 44 may have an annular bump-out portion 61 that is defined in the tube body 46 and the annular bump-out portion 61 may be positioned between the first open end 48 and the second open end 50. In some embodiments, the annular bump-out portion 61 may have a different (i.e., larger or smaller) diameter 63 than the diameter 53 of the tube assembly 44. As such, the axial distance 52 of the tube assembly 44 may be configured to accommodate the axial dimension of the annular bump-out portion 61 and the placement of the sensor 58 (FIG. 3) within the tube body 46. In one non-limiting example, the aperture 60 may be formed in the outer surface 62 and extends into the interior portion 64 (FIG. 3) of the tube body 46, and the aperture 60 is positioned somewhere between the first open end 48 and the second open end 50.

Additionally, the aperture 60 may be positioned along the tube body 46 such that the aperture 60 extends through a portion of the annular bump-out portion 61; however other locations for the aperture 60 are possible. As a result, the axial distance 52 between the first open end 48 and the second open end 50 may be specified according to space needed to form the aperture 60 and the space needed to accommodate the annular bump-out portion 61. The axial distance 52 may be further specified to optimally position the sensor 58 (FIG. 3) within the interior portion 64 of the tube body 46 so the sensor 58 is able to monitor and collect data from the engine fluid. Moreover, the annular bump-out portion 61 may be configured to direct or otherwise influence the fluid flow within the interior portion 64 of the tube body 46. Therefore, in some cases the diameter 63 and other dimensions of the annular bump-out portion 61 may be configured to optimize fluid flow across the sensor 58.

As discussed above, the tube assembly 44 may be used to create a fluid pathway that extends between the first open end 48 and the second open end 50 such that engine fluid that is poured into the secondary fluid fill port 51 may flow through the tube body 46 towards the first open end 48. In some embodiments, the tube assembly 44 may be aligned with the fluid fill port 40 (FIG. 2) that is formed in the top surface 42 of the valve cover 38. Furthermore, the tube assembly 44 may be configured such that the tube assembly 44 can be removably coupled to the top surface 42 of the valve cover (FIGS. 2 and 3). In some embodiments, the tube assembly 44 may include a tube attachment portion 66 located adjacent to the first open end 48 of the tube assembly 44. In one non-limiting example, the tube attachment portion 66 may include an annular groove 68 that is formed in the outer surface 62 of the tube body 46. The annular groove 68 may be formed adjacent to the first open end 48 of the tube assembly 44, and the annular groove 68 is a continuous feature formed around the circumference of the tube body 46. Alternatively, the annular groove 68 may be configured as a non-continuous feature formed around the tube body 46; however, other configurations of the tube attachment portion 66 and the annular groove 68 are possible. Moreover, the annular groove 68 of the tube attachment portion 66 may mate, or otherwise correspond with, a locking portion 70 on the valve cover 38 (see FIG. 2). In some embodiments, the locking portion 70 (FIG. 2) may be configured to circumferentially surround the fluid fill port 40 (FIG. 2) and align the tube assembly 44 with fluid fill port 40 (FIG. 2). The locking portion 70 (FIG. 2) may be alternatively configured as needed to facilitate the locking and/or coupling of the tube assembly 44 with the valve cover 38 (FIGS. 2 and 3). As a result, when the tube assembly 44 is coupled with the valve cover 38, the tube assembly 44 may completely surround and enclose the fluid fill port 40 (FIGS. 2 and 3) formed in the valve cover 38.

In some embodiments, the tube assembly 44 may be used to form an extended fluid fill pathway which leads from the secondary fluid fill port 51 at the second open end 50 of the tube assembly 44 to the fluid fill port 40 formed in the valve cover 38 (FIGS. 2 and 3). As such, the tube assembly 44 may be aligned with the fluid fill port 40 (FIGS. 2 and 3) and sealingly coupled to the top surface 42 of the valve cover (FIG. 3). In one non-limiting example, the first open end 48 of the tube assembly 44 may include an attachment portion chamfer 71 which forms an angular sealing surface. The attachment portion chamfer 71 may be configured to sealingly engage, or otherwise mate, with the fluid fill port 40 formed on the valve cover 38 (FIGS. 2 and 3) to form a fluid tight seal between the tube assembly 44 and the valve cover 38 (FIGS. 2 and 3).

Furthermore, the fluid fill pathway formed by the tube assembly 44 may extend between the first open end 48 and the second open end 50 of the tube assembly 44, and the secondary fluid fill port 51 may be defined at the second open end 50 of the tube assembly 44. Additionally, the second open end 50 may be configured with a lip, a flange 72, or other such feature, that extends radially outward from the second open end 50 of the tube assembly 44. The flange 72 may form a cap attachment portion 73 of the second open end 50 of the tube assembly 44 such that the removable cap 56 (FIG. 3) may be positioned over the cap attachment portion 73 to cover the second open end 50 when not in use. As illustrated in FIGS. 4 and 5, the flange 72 may be configured to circumferentially surround the second open end 50 in order to define the cap attachment portion 73; however other configurations of the flange 72 are possible. Additionally, the flange 72 may include a flange chamfer 75 that forms an angular sealing surface that circumferentially surrounds the periphery of flange 72.

As discussed above, the removable cap 56 (FIG. 3) may be configured to be removably fastened or otherwise secured to the flange 72 in order to cover the second open end 50 of the tube assembly 44 when the secondary fluid fill port 51 is not in use. Additionally, when the removable cap 56 is positioned over the second open end 50, the removable cap 56 may sealingly engage with the flange 72 to form a fluid tight seal between the flange 72 and the removable cap 56. In one non-limiting example, the removable cap 56 mates with the angular sealing surface formed by the flange chamfer 75 to form the fluid tight seal. In some embodiments, a sealing element (not shown) such as but not limited to, an O-ring or gasket, may be combined with the flange chamfer 75 to help form the fluid tight seal.

The tube assembly 44 may further include an internal fluid flow pathway 74 defined within the interior portion 64 of the tube body 46. The internal fluid flow pathway 74 may be configured to direct the flow of engine fluid, or other fluid that may be poured into the tube assembly 44. In some embodiments, the internal fluid flow pathway 74 may be further configured to optimize the flow of engine fluid with respect to the portion of the sensor 58 (FIG. 3) that extends through the aperture 60 and into the interior portion 64 of the tube body 46. In one non-limiting example illustrated in FIGS. 5 and 6, the internal fluid flow pathway 74 may be defined by at least two circular segments 76 that are formed in a guttering structure 78 contained within the interior portion 64 of the tube body 46. The circular segments 76 may create openings in the guttering structure 78 that engine fluid, or other such fluid, may pass through as the engine fluid is poured into the secondary fluid fill port 51. Additionally, the circular segments 76 may be sized and positioned in the guttering structure 78 to shape or direct the flow of engine fluid as it is poured into the tube assembly 44. In some embodiments, the guttering structure 78 may be incorporated with the annular bump-out portion 61, and the guttering structure 78 and the annular bump-out portion 61 may shape or direct the engine fluid flow within the internal fluid flow pathway 74 in order to optimize the engine fluid interaction with the sensor 58 (FIG. 3).

Generally, the guttering structure 78 may be formed as a unitary structure within the interior portion 64 of the tube body 46. As a result, the guttering structure 78 may be integrated with the interior portion 64 of the tube body 46. However, in an alternative embodiment the guttering structure 78 may be configured as an insert that is placed within the interior portion 64 of the tube body 46. As further illustrated in FIG. 6, the guttering structure 78 may be a circular shaped structure integrated into the circular area within the interior portion 64 of the tube body 46. The guttering structure 78 may have a guttering structure diameter 80 appropriately sized to fit within the inner diameter of the tube body 46 and the circular segments 76 may create semi-circular openings within the guttering structure 78. Additionally, the guttering structure 78 may have an arcuate notch 86 extending inwards from the outer circumference of the guttering structure 78. In some embodiments, the circular segments 76 and the arcuate notch 86 may be used to help direct the flow of engine fluid across the sensor 58. Furthermore, the guttering structure 78 including the circular segments 76 and the arcuate notch 86 may be positioned above the aperture 60 in order to direct and shape the flow of engine fluid across the sensor 58 (FIG. 3) that is positioned within the interior portion 64 of the tube body 46.

Figure 6:
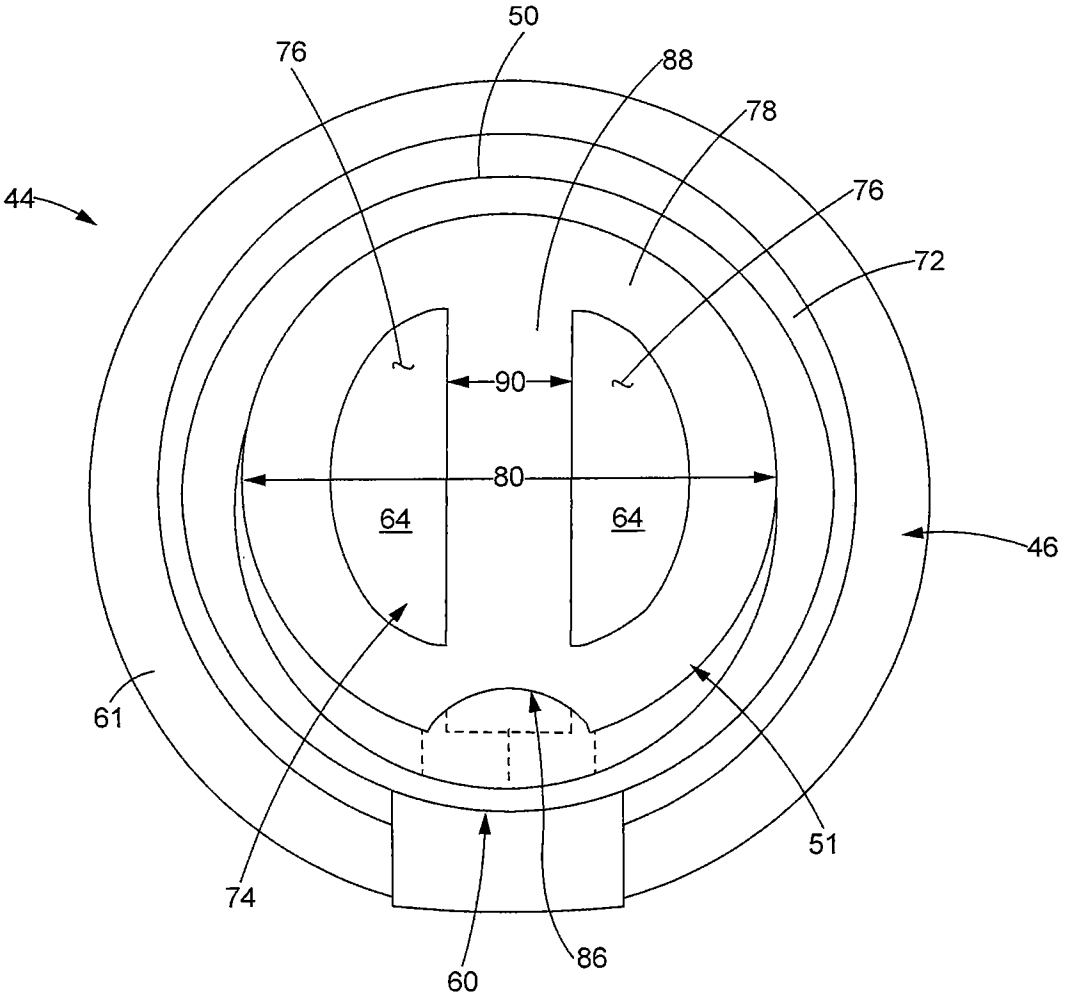
FIG. 6 is top view of the tube assembly of FIGS. 4 and 5, in accordance with an embodiment of the present disclosure.

The at least two circular segments 76 opened in the guttering structure 78 may serve to direct a bulk portion of the engine fluid, or other such fluid, that is poured into the secondary fluid fill port 51 through the tube assembly 44. Additionally, the annular bump-out portion 61 may work with the circular segments 76 and the arcuate notch 86 to direct a portion of the engine fluid, or other such fluid that is poured into the secondary fluid fill port 51 to flow past the sensor 58 (FIG. 3) so the sensor may monitor or sense a characteristic (i.e., clarity, cleanliness, viscosity, or other characteristic) of the fluid as it flows past the sensor 58 (FIG. 3). In some embodiments, the guttering structure 78 may be further configured with a closed region 88 that is disposed between the two circular segments 76 formed in the guttering structure 78. The closed region 88 may be configured with a specific width 90 that corresponds to a desired size for the two circular segments 76. In some embodiments, the width 90 of the closed region 88 may be increased to cause a corresponding decrease in the size of the two circular segments 76. Alternatively, the width 90 of the closed region 88 may be decreased to cause a corresponding increase in the size of the two circular segments 76. The guttering structure 78 in FIG. 6 illustrates the use of two circular segments 76 and the arcuate notch 86 to form openings in the guttering structure 78 that direct the flow of engine fluid, or other such fluid, through the tube assembly 44. However, it will be understood that other opening shapes and configurations may be used to direct the fluid flow.

Figure 7:
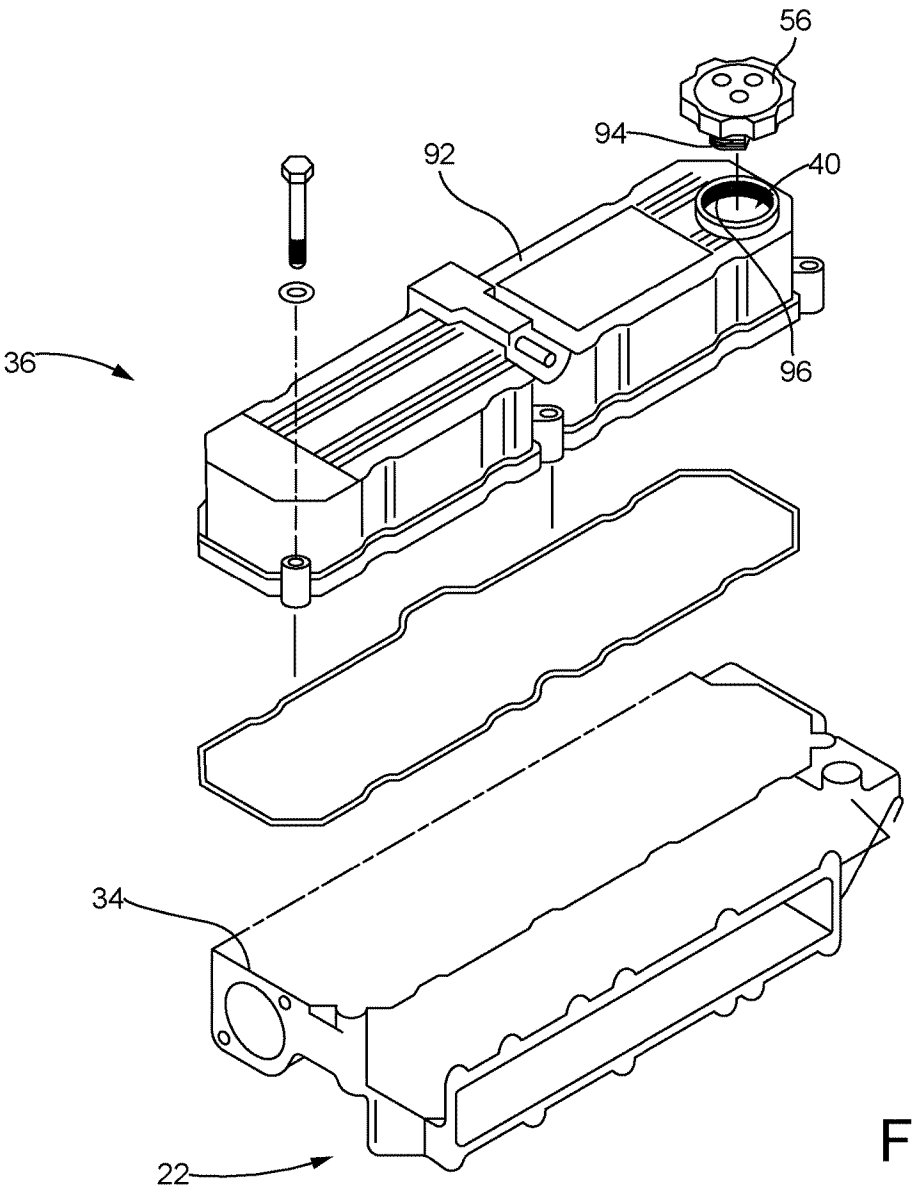
FIG. 7 is an exploded perspective view of the engine in the machine of FIG. 1, in accordance with an alternative embodiment of the present disclosure.

Referring to FIG. 7 an alternative embodiment of the valve cover 92 is illustrated. The valve cover 92 may be configured to cover the cylinder head bank 36 of the engine 22. Similar to the valve cover 38 shown in FIG. 2, the valve cover 92 may include the fluid fill port 40 which can be used to pour or dispense engine fluid into the engine 22. Furthermore, the fluid fill port 40 may be covered with the removable cap 56 when engine fluid is not being added to the engine 22. As further shown in FIG. 7, some embodiments of the removable cap 56 may include a set of threads 94 that are configured to mate with a corresponding threaded locking portion 96 of the valve cover 92. As a result, the removable cap 56 may be secured or otherwise attached to the valve cover 92 by screwing the set of threads 94 of the removable cap 56 into the threaded locking portion 96 of the valve cover 92. However, the removable cap 56 may be attached and or secured to the valve cover 92 using other attachment devices.

Referring back to FIGS. 4 and 5, with continued reference to FIG. 7, the tube attachment portion 66 of the tube assembly 44 may be alternately configured to be compatible with the threaded locking portion 96 of the valve cover 92. In one non-limiting example, the tube attachment portion 66 may include a set of threads 98 in addition to or in place of the annular groove 68 that is formed in the outer surface 62 of the tube body 46. Similar to the annular groove 68, the set of threads 98 may be positioned adjacent to the first open end 48 of the tube assembly 44. Moreover, the set of threads 98 of the tube attachment portion 66 may mate, or otherwise correspond with the threaded locking portion 96 of the valve cover 92. In some embodiments, the tube attachment portion 66 may be inserted into at least a portion of the fluid fill port 40 and positioned within the fluid fill port 40 such that the set of threads 98 on the tube attachment portion 66 interact with the threaded locking portion 96 of the valve cover 92 to align the tube assembly 44 with fluid fill port 40. Additionally, the set of threads 98 on the tube assembly 44 may be screw into the corresponding threaded locking portion 96 of the valve cover 92 to fixedly attach the tube assembly 44 to the valve cover 92. As a result, the tube assembly 44 may form the extended fluid fill pathway which leads from the secondary fluid fill port 51 at the second open end 50 of the tube assembly 44 to the fluid fill port 40 formed in the valve cover 92.

Furthermore, the fluid fill pathway formed by the tube assembly 44 may extend between the first open end 48 and the second open end 50 of the tube assembly 44, and the secondary fluid fill port 51 may be defined at the second open end 50 of the tube assembly 44. Additionally, as illustrated in FIG. 5, the cap attachment portion 73 of the second open end 50 of the tube assembly 44 may include a set of threads 100 formed on an interior surface 102 of the tube assembly 44. In some embodiments, the set of threads 100 of the cap attachment portion 73 are configured to mate with the set of threads 94 formed on the removable cap 56 such that the removable cap 56 may be screwed into the cap attachment portion 73 to cover the second open end 50 of the tube assembly 44 when not in use.

As discussed above, the removable cap 56 may be configured to be removably fastened or otherwise secured to the cap attachment portion 73 in order to cover the second open end 50 of the tube assembly 44 when the secondary fluid fill port 51 is not in use. As such, when the set of threads 94 of the removable cap 56 are screwed into the set of threads 100 of the cap attachment portion 73, the removable cap 56 may sealingly engage with the flange 72 to form a fluid tight seal between the flange 72 and the removable cap 56. In one non-limiting example, screwing the removable cap 56 into the cap attachment portion 73 may cause the removable cap 56 to mate with the angular sealing surface formed by the flange chamfer 75 to form the fluid tight seal. Furthermore, a sealing element (not shown) such as but not limited to, an O-ring or gasket, may be combined with the flange chamfer 75 to help form the fluid tight seal.

Figure 8:
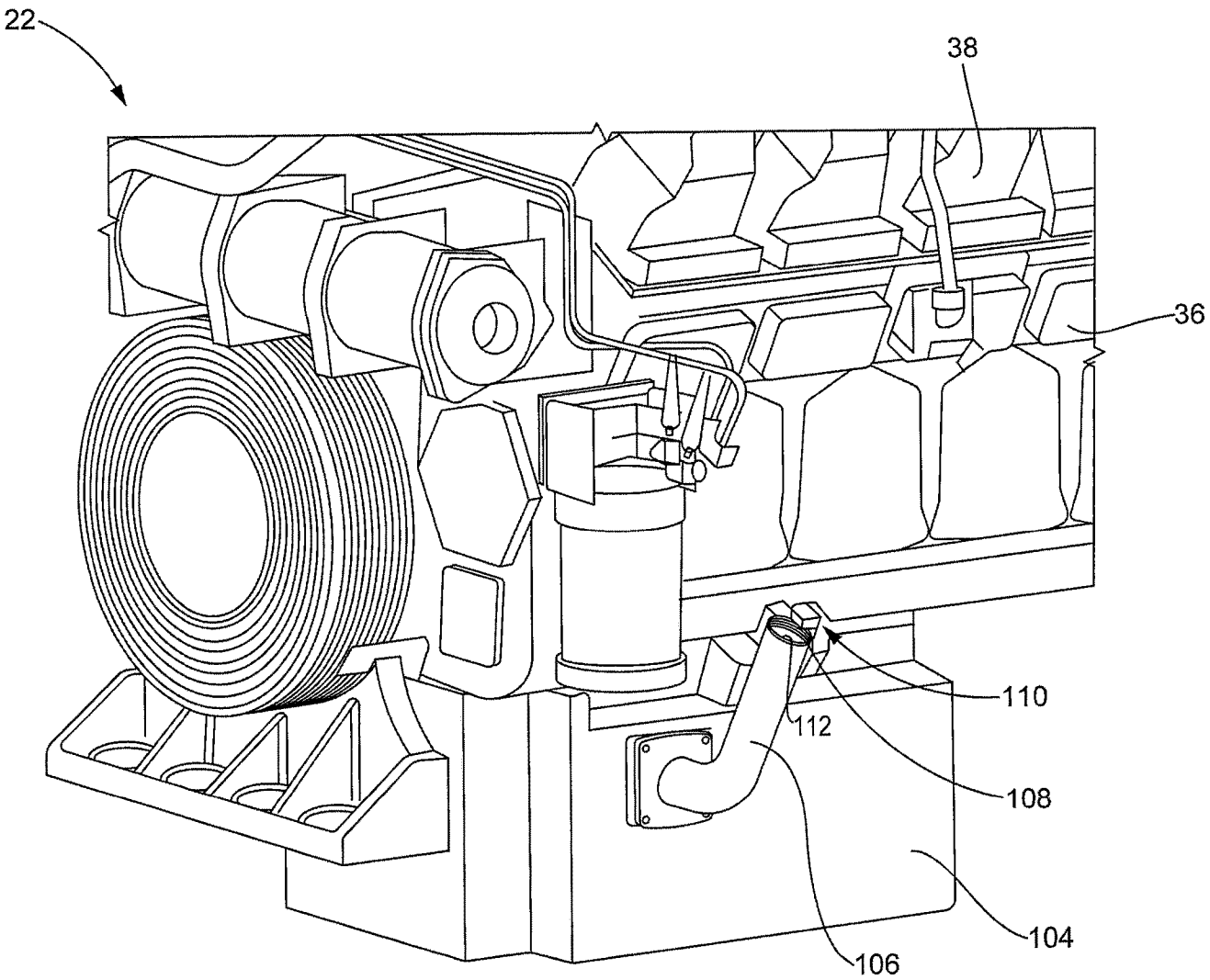
FIG. 8 is a perspective view of the engine in the machine of FIG. 1, in accordance with an alternative embodiment of the present disclosure.

Referring to FIG. 8 an alternative embodiment of the engine 22 is shown. The engine 22 includes at least one cylinder head bank 36 which is covered by one or more valve covers 38. Furthermore, the engine 22 may include a fluid reservoir 104 that is configured to store fluid used by the engine 22 during operation. FIG. 8 provides one non-limiting example where the fluid reservoir 104 is positioned underneath the cylinder head bank 36; however the fluid reservoir 104 may be located in other positions and locations of the machine 20 (FIG. 1), as needed. In some embodiments, the fluid reservoir 104 may be coupled to a fluid fill tube 106, and the fluid fill tube 106 may be used to fill the fluid reservoir 104 with a fluid such as but not limited to, engine oil, engine coolant, hydraulic fluid, or other such fluid. In one non-limiting example, the engine 22 may be configured with the fluid fill tube 106 in place of the fluid fill port 40 on the valve cover 38, 92 (FIGS. 2,3, and 7) to fill the engine 22 with the desired fluid. Alternatively or additionally, the engine 22 may be configured with both the fluid fill tube 106 and the fluid fill port 40 formed in the valve cover 38 (FIGS. 2, 3, and 7).

Similar to the fluid fill port 40 (FIGS. 2, 3, and 7), some embodiments of the fluid fill tube 106 may be configured to mate with, or otherwise attach to the tube assembly 44 (FIGS. 3-5). The fluid fill tube 106 may be configured with an open end 108 that provides an opening for filling or otherwise dispensing a fluid into the fluid reservoir 104. Additionally, the open end 108 may further include a fill tube locking portion 110 configured to mate with the tube attachment portion 66 of the tube assembly 44 (FIGS. 4 and 5). One non-limiting example of the fill tube locking portion 110 may be configured similarly to the locking portion 70 of the valve cover 38 (FIG. 2). As such, the tube assembly 44 (FIGS. 4 and 5) may be fixedly attached to the fluid fill tube 106 using the annular groove 68 formed in the tube attachment portion 66 of the tube assembly 44 (FIGS. 4 and 5). Alternatively, the fill tube locking portion 110 may be similarly configured as the threaded locking portion 96 of the valve cover 92 (FIG. 7). Therefore, the set of threads 98 on the tube attachment portion 66 (FIG. 4) may mate or otherwise align with a set of threads 112 formed on the fill tube locking portion 110, and the tube assembly 44 (FIGS. 4 and 5) may be screwed into the open end 108 to fixedly attach the tube assembly 44 (FIGS. 4 and 5) to the fluid fill tube 106.

In some embodiments, the fluid fill tube 106 may have a cover or cap (not shown) similar to the removable cap 56 (FIGS. 3 and 7) that covers the fluid fill port 40 in the valve cover 38, 92 (FIGS. 3 and 7). Furthermore, the fill tube cap (not shown) may be removed from the fluid fill tube 106 such that the tube assembly 44 (FIGS. 4 and 5) may be attached and secured to the open end 108 of the fluid fill tube 106 to extend the fluid fill pathway for engine fluid being dispensed into the fluid fill tube 106. Moreover, the fill tube cap (not shown) may be used to cover the second open end 50 of the tube assembly 44 (FIGS. 4 and 5) when not in use.

INDUSTRIAL APPLICABILITY

In general, the tube assembly 44 of the present disclosure can find applicability in engines 22 and other machine components used throughout many industries, including but not limited to, earth moving, mining, agricultural, marine, construction, power generation, and other such industries. Furthermore, the tube assembly 44 may include one or more sensors 58 that can be configured to monitor and/or analyze one or more fluids that are used in the engine 22 and other machine systems. More specifically, in one non-limiting example the tube assembly 44 may be aligned with a fluid fill port 40 formed in the valve cover 38 or other such engine component and the tube assembly 44 may be used to pour or dispense engine fluid into the fluid fill port 40. The one or more sensors 58 may be arranged within the tube assembly 44 and the sensors 58 may monitor and collect engine fluid data as the fluid flows through the tube assembly 44. The tube assembly 44 may be removably attached, or otherwise mounted to the valve cover 38, and in some cases, the tube assembly 44 may remain attached to the valve cover 38 during machine 20 operation. As a result, the tube assembly 44 may need to be configured to provide space for the one or more sensors 58 and to be compatible with the space available within the engine compartment 26 of the machine 20. While attachment of the tube assembly 44 to the valve cover 38 is described above, it will be understood that the tube assembly 44 may be attached to other components of the machine 20. For example, the tube assembly 44 may be attached to a hydraulic fluid fill port (not shown), and the sensor 58 may be positioned within the tube assembly 44 and configured to monitor and collect data of hydraulic fluid that may be poured or otherwise dispensed through the tube assembly 44. The tube assembly 44 may be used to monitor other machine fluids such as but not limited to, fuel, coolant, and the like.

In one non-limiting example, the tube assembly 44 may be removably attached to the valve cover 38 in order to extend the fluid fill port 40 away from the top surface 42 of the valve cover 38. The tube assembly 44 may be aligned with the fluid fill port 40 formed in the valve cover 38, and the tube assembly 44 may be configured to assist filling engine fluid into the fluid fill port 40. Moreover, the tube assembly 44 may have a tube attachment portion 66 that is configured to mate with a locking portion 70 on the valve cover 38. As a result, the tube assembly 44 may be fixedly attached or otherwise coupled to the valve cover 38. In one non-limiting example, the tube attachment portion 66 of the tube assembly 44 may include an annular groove 68 that is configured to engage or mate with the locking portion 70 (i.e., tabs or a groove) formed on the valve cover 38. Moreover, the tube assembly 44 may be configured to surround or otherwise mate with the fluid fill port 40 to form a fluid tight seal between the fluid fill port 40 and the tube assembly 44. In some embodiments, the tube attachment portion 66 of the tube assembly 44 includes an attachment portion chamfer 71 that sealingly engages, or otherwise mates with the fluid fill port 40 to form a fluid tight seal between the tube assembly 44 and the fluid fill port 40 formed in the valve cover 38. Additionally, a sealing element (not shown), such as but not limited to, an O-ring or gasket may be positioned between the tube attachment portion 66 and the fluid fill port 40 to help form and maintain the fluid tight seal. The tube assembly 44 may be further configured to have a cap attachment portion 73 that includes a flange 72 that circumferentially surrounds the second open end 50 of the tube assembly 44. The cap attachment portion 73 may be configured to secure or otherwise mate with the removable cap 56 that covers the second open end 50 when the secondary fluid fill port 51 is not in use. Moreover, the cap attachment portion 73 and the fluid fill port 40 formed in the valve cover 38 are similarly configured such that the removable cap 56 can also be secured to the fluid fill port 40 when the tube assembly 44 is not attached to the valve cover 38.

In one non-limiting example, the tube assembly 44 provides an extension to the fluid fill port 40 by first removing the removable cap 56 covering the fluid fill port 40. The tube attachment portion 66 of the tube assembly 44 may then be aligned with the fluid fill port 40, and the tube attachment portion 66 engages with the locking portion 70 formed on the valve cover 38 to fixedly attach the tube assembly 44 to the valve cover 38. If engine fluid needs to be added to the engine 22, or other component of the machine 20, then the engine fluid may be poured or dispensed into the secondary fluid fill port 51 at the second open end 50 of the tube assembly 44. The engine fluid will then flow into the engine 22 through the fluid fill port 40 because the secondary fluid fill port 51 and the fluid fill port 40 formed in the valve cover 38 are fluidly connected by the tube assembly 44. Alternatively, if engine fluid does not need to be added to the engine 22, then the removable cap 56, which was previously covering the fluid fill port 40, may be secured to the cap attachment portion 73 to cover the second open end 50 of the tube assembly 44.

In some embodiments, the tube assembly 44 may be configured with a sensor 58 that is inserted into an aperture 60 formed in the tube body 46. The aperture 60 may be positioned between the first open end 48 and the second open end 50 of the tube assembly 44, and the sensor 58 may be inserted into the aperture 60. Furthermore, the sensor 58 may be orientated such that at least a portion of the sensor 58 is positioned within the interior portion 64 of the tube body 46 and the sensor 58 is able to interact with the engine fluid as the fluid flows between the second open end 50 and the first open end 48 of the tube body 46. The sensor 58 may be configured to monitor and collect data from the engine fluid as it flows by the sensor 58. For example, the sensor 58 may monitor certain characteristics of the engine fluid, such as but not limited to, clarity, viscosity, temperature, flow rate, particle count, pH, and other such fluid characteristics.

Once the tube assembly 44 is positioned on the valve cover 38 and the sensor 58 is properly positioned within the aperture 60, then the engine fluid, or other such fluid, may be poured into the secondary fluid fill port 51 located at the second open end 50 of the tube assembly 44. As discussed above, the engine fluid poured through the tube assembly 44 may be engine oil; however the tube assembly 44 may be used during the filling of other fluids as well. In some embodiments, the engine oil, or other such fluid is poured or otherwise dispensed into the secondary fluid fill port 51, and the engine oil, or other such fluid flows past the sensor 58 positioned in the aperture 60. In one non-limiting example, the sensor 58 may be configured as an ultra-violet light (UV) sensor and the engine oil may include a UV sensitive marker, or other such material, that can be detected as the engine oil flows across the sensor 58 (i.e., UV sensor). Alternatively, the sensor 58 may be configured as a color sensor, a pH sensor, a particle sensor, a flow sensor, a temperature sensor, or other such sensor. Furthermore, the sensor 58 may monitor and collect data related to the engine oil such as but not limited to, fluid clarity, fluid viscosity, fluid temperature, fluid flow rate, fluid particle count, fluid pH, or other such fluid characteristic, as the engine oil flows across the sensor 58. The collected data may then be transmitted to the electronic controller 29 or other such computing device, for further analysis and/or storage to be accessed later.

The sensor 58 may be in direct communication with the electronic controller 29 or other such computing device located on the machine 20. In one non-limiting example the sensor 58 is communicably coupled to the electronic controller 29 through one or more lead wires 65. Alternatively, the sensor 58 and the electronic controller 29 may be wirelessly coupled to one another using wireless communication technology such as but not limited to, Bluetooth, near-field communication, radio frequency communication, Wi-Fi communication, cellular communication, or other such wireless communication technology. The electronic controller 29 may include memory modules configured to save and store data which is collected by the sensor 58 and transmitted to the electronic controller 29. The electronic controller 29 may include software or other executable commands that are programmed to analyze the data collected by the sensor 58. In some embodiments, the electronic controller 29 may further include a microprocessor configured to execute the software, programs, and/or algorithms that are installed on the electronic controller 29. Moreover, the electronic controller 29 may include memory modules such as but not limited, to read-only memory, random access memory, hard disk memory, solid state memory, and other such memory modules. The memory modules may provide storage space for the software, programs, algorithms, and data received from the sensor 58. Furthermore, the memory modules may organize and store the data generated during the execution of the software, programs, and/or algorithms and the analysis of the data received from the sensor 58.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. A tube assembly for attaching to a fluid fill port, the tube assembly comprising:

a tube body extending between a first open end and a second open end;

a tube attachment portion formed at the first open end, wherein the tube attachment portion of the tube body is inserted into the fluid fill port and the first open end is aligned with and coupled to the fluid fill port;

a fill portion defined at the second open end of the tube body, the fill portion is spaced an axial distance away from the tube attachment portion;

a removable cap configured to be secured onto the second open end and cover the fill portion;

an aperture formed in the tube body, the aperture located between the first open end and the second open end and the aperture configured to extend from an outer surface of the tube body into an interior portion of the tube body;

a sensor inserted through the aperture, wherein at least a portion of the sensor is positioned within the interior portion of the tube body, and wherein the sensor is configured to monitor at least one fluid characteristic of a fluid that is dispensed into the fill portion and flows through the interior portion of the tube body into the fluid fill port; and a guttering structure positioned within the interior portion of the tube body and defining an internal fluid flow pathway of the fluid dispensed into the fill portion, the guttering structure including a closed region disposed between at least one opening, the closed region being tilted within the interior portion of the tube body to direct the internal fluid flow pathway such that at least a portion of the fluid dispensed into the fill portion flows past the sensor.

2. The tube assembly of claim 1, wherein the tube attachment portion includes a chamfer formed around the first open end, wherein the chamfer is configured to mate with a corresponding sealing surface formed within the fluid fill port and the chamfer and the corresponding sealing surface create a fluid tight seal when the first open end of the tube body is inserted into the fluid fill port.

3. The tube assembly of claim 1, wherein the tube attachment portion further includes an annular groove formed into the outer surface of the tube body, the annular groove is formed interior to the first open end and configured to mate with the fluid fill port to couple the tube body to the fluid fill port.

4. The tube assembly of claim 1, further comprising a cap attachment portion, wherein the cap attachment portion includes a flange that extends radially outward from the second open end, and wherein the flange is configured to mate with the removable cap to securely position the removable cap and cover the second open end of the tube body.

5. The tube assembly of claim 4, wherein the flange of the cap attachment portion further includes a flange chamfer formed around the second open end, and wherein the flange chamfer is configured to sealingly engage with the removable cap to form a fluid tight seal.

6. The tube assembly of claim 1, wherein the sensor is communicably coupled to an electronic controller, wherein the sensor transmits a sensor data set to the electronic controller, and wherein the electronic controller is programmed to analyze and store the sensor data set.

7. The tube assembly of claim 1, wherein the sensor comprises at least one of light sensor, a color sensor, a particle sensor, a pH sensor, a flow sensor, and a temperature sensor.

8. The tube assembly of claim 1, wherein the guttering structure includes a first opening and a second opening, and wherein the first opening and the second opening are configured to direct the internal fluid flow pathway such that at least a portion of the fluid dispensed into the tube assembly flows through the tube body toward the first open end.

9. A tube assembly for extending a fluid fill port of an engine valve cover, the tube assembly comprising:

a tube body extending between a first open end and a second open end;

a tube attachment portion formed at the first open end, wherein the tube attachment portion of the tube body is inserted into the fluid fill port and the first open end is aligned with the fluid fill port and the tube attachment portion is coupled to the engine valve cover;

a fill portion defined at the second open end of the tube body, the fill portion is spaced an axial distance away from the tube attachment portion;

a cap attachment portion formed at the second open end of the tube body, the cap attachment portion configured to secure a removable cap of the engine valve cover that covers the fill portion when not in use;

an aperture formed in the tube body, the aperture located between the first open end and the second open end and the aperture configured to extend from an outer surface of the tube body into an interior portion of the tube body;

a sensor inserted into the aperture, wherein at least a portion of the sensor is positioned within the interior portion of the tube body, and wherein the sensor is configured to monitor at least one fluid characteristic of an engine fluid that is dispensed into the fill portion and flows through the interior portion of the tube body into the engine valve cover; and a guttering structure formed within the interior portion of the tube body and defining an internal fluid flow pathway within the interior portion of the tube body, the guttering structure including a closed region disposed between at least one opening, the closed region being tilted within the interior portion of the tube body to direct the internal fluid flow pathway such that at least a portion of the fluid dispensed into the fill portion flows past the sensor.

10. The tube assembly of claim 9, wherein the tube attachment portion includes a chamfer formed around the first open end, wherein the chamfer is configured to mate with a corresponding sealing surface within the fluid fill port, and wherein the chamfer and the corresponding sealing surface create a fluid tight seal when the first open end of the tube body is inserted into the fluid fill port.

11. The tube assembly of claim 9, wherein the tube attachment portion further includes an annular groove formed in the outer surface of the tube body, wherein the annular groove is formed adjacent to the first open end and configured to mate with a corresponding tube assembly attachment tab formed on the fluid fill port such that the tube assembly is coupled to the engine valve cover.

12. The tube assembly of claim 9, wherein the cap attachment portion includes a flange that extends radially outward from the second open end, and wherein the flange is configured to mate with the removable cap and securely position the removable cap to cover the second open end of the tube body.

13. The tube assembly of claim 12, wherein the flange of the cap attachment portion further includes a flange chamfer formed around the second open end, and wherein the flange chamfer is configured to sealingly engage with the removable cap to form a fluid tight seal between the cap attachment portion and the removable cap.

14. The tube assembly of claim 9, wherein the sensor is communicably coupled to an electronic controller, and wherein the sensor transmits a sensor data set to the electronic controller and the electronic controller is programmed to analyze and store the sensor data set.

15. The tube assembly of claim 9, wherein the sensor comprises at least one of a light sensor, a color sensor, a particle sensor, a pH sensor, a flow sensor, and a temperature sensor.

16. The tube assembly of claim 9, wherein the guttering structure is a removable insert having an outer diameter that is slightly less than a diameter of the tube body, and wherein the removable insert is positioned within the interior portion of the tube body between the first open end and the second open end.

17. The tube assembly of claim 16, wherein the removable insert includes a first opening and a second opening, and wherein the first opening and the second opening are configured to direct the internal fluid flow pathway such that at least a portion of the engine fluid dispensed into the tube assembly flows through the tube body toward the first open end.

18. A machine comprising:

an engine compartment configured to house an engine, and the engine includes at least one valve cover;

a valve cover fluid fill port formed in the at least one valve cover, the valve cover fluid fill port configured for filing the engine with an engine fluid;

a tube assembly coupled to the valve cover fluid fill port, the tube assembly comprising:

a tube body extending between a first open end and a second open end;

a tube attachment portion formed at the first open end of the tube body, wherein the first open end of the tube body is inserted into the valve cover fluid fill port and the first open end is aligned with the valve cover fluid fill port and the tube attachment portion is coupled to the at least one valve cover;

a fill portion defined at the second open end of the tube body, the fill portion is spaced an axial distance away from the tube attachment portion;

a cap attachment portion formed at the second open end of the tube body, the cap attachment portion configured to secure a removable cap of the at least one valve cover that covers the fill portion when not in use;

an aperture extending through an outer surface of the tube body into an interior portion of the tube body, and the aperture positioned along the axial distance between the tube attachment portion and the fill portion;

a sensor inserted into the aperture, wherein at least a portion of the sensor is positioned within the interior portion of the tube body, and wherein the sensor is configured to monitor at least one fluid characteristic of the engine fluid that is dispensed into the fill portion and flows through the interior portion of the tube body into the at least one valve cover;

a guttering structure inserted within the interior portion of the tube body proximate the second open end of the tube body, the guttering structure defining an internal fluid flow pathway to direct the flow of the fluid dispensed into the fill portion of the tube assembly toward the first open end of the tube body, the guttering structure including a closed region disposed between at least one opening, the closed region being tilted within the interior portion of the tube body to direct the internal fluid flow pathway such that at least a portion of the fluid dispensed into the fill portion flows past the sensor; and an electronic controller communicably coupled to the sensor, wherein the sensor transmits a sensor data set to the electronic controller and the electronic controller is programmed to analyze and store the sensor data set.

19. The machine of claim 18, wherein the sensor comprises at least one of a light sensor, a color sensor, a particle sensor, a pH sensor, a flow sensor, and a temperature sensor.

* * * * *